United States Patent [19]

Dibrell

[11] 4,420,944

[45] Dec. 20, 1983

[54] AIR COOLING SYSTEM

[75] Inventor: Edwin W. Dibrell, San Antonio, Tex.

[73] Assignee: Centrifugal Piston Expander, Inc., San Antonio, Tex.

[21] Appl. No.: 418,651

[22] Filed: Sep. 16, 1982

[51] Int. Cl.[3] ..... F25B 9/00

[52] U.S. Cl. ..... 62/86; 62/402; 62/499; 165/86

[58] Field of Search ..... 62/499, 86, 402; 165/86

[56] References Cited

U.S. PATENT DOCUMENTS

| | | | |
|---|---|---|---|
| 1,323,785 | 12/1919 | Nichol . | |
| 1,511,985 | 10/1924 | Spencer . | |
| 2,174,584 | 10/1939 | Imus . | |
| 2,175,162 | 10/1939 | Waterfill . | |
| 2,730,874 | 1/1956 | Schelp . | |
| 3,052,106 | 9/1962 | Sampietro et al. . | |
| 3,623,332 | 11/1971 | Fernandes . | |
| 3,648,670 | 3/1972 | Siddons . | |
| 3,874,188 | 4/1975 | Zara et al. . | |
| 3,896,632 | 7/1975 | Huntley . | |
| 3,937,030 | 2/1976 | Jaspers . | |
| 4,022,032 | 5/1977 | Nott | 62/499 |
| 4,334,411 | 6/1982 | Payne . | |

*Primary Examiner*—Ronald C. Capossela

*Attorney, Agent, or Firm*—Wilson, Fraser, Barker & Clemens

[57] ABSTRACT

An air cooling system is provided wherein a refrigerant gas, which may be air, is expanded in a plurality of piston and cylinder elements which are concurrently rotated by a power driven shaft. The reaction force of the expanding gas produces mechanical energy assisting in the rotation of the power shaft. Valving arrangements are provided for supplying pressured gas to separate sets of piston and cylinder elements in timed sequence, if desired. The expanded, cooled gas is directed through a heat exchanger mounted on the rotating power shaft and returned to a compressor, also mounted on the rotating power shaft, for recompression and resupply to the rotating piston and cylinder elements. Alternately, the cooled gas may be fed directly into the room to be cooled.

34 Claims, 10 Drawing Figures

AIR COOLING SYSTEM

BACKGROUND OF THE INVENTION

1. Field of the Invention

The invention relates to a method and apparatus for efficiently extracting heat and mechanical energy from a pressured gas and utilizing the cooled gas as the heat removal element of an air conditioning or cooling system.

2. History of the Prior Art

Many mechanisms and methods have heretofore been proposed for effecting the extraction of heat from a refrigerant fluid as one step in the operation of an air conditioning or refrigerating system. The most common method of heat removal is by conducting the heated gas through a heat exchanger and subjecting it to the cooling action of a flow of cooling air or water. Such systems necessarily involve the location of the cooling mechanism exteriorly of the space to be air conditioned or refrigerated. Most conventional systems therefore required one motor to effect the compression of the refrigerant fluid to convert it from a gas to a liquid and to drive a cooling fan for removing the heat involved in the compressor operation, and a second motor to move room air through an evaporator. The cooling was achieved by evaporation of the liquified refrigerant fluid in the evaporator to produce a cooling effect on air or other fluid stream passing in proximity to the evaporator. In any event, most prior art systems involve the use of substantial amounts of energy to effect the desired cooling action. Furthermore, special refrigerant fluids, such as Freon, were required.

In the co-pending application of James G. Adams, Ser. No. 343,240, filed Jan. 28, 1982, and assigned to the assignee of the instant application, there is disclosed a prime mover for an air conditioning system which involves the extraction of both heat and mechanical energy from a pressured refrigerant gas through the non-combustible expansion of such gas in a piston and cylinder assembly wherein the piston and cylinder are relatively movable with respect to each other. Such piston and cylinder assemblies are, however, mounted for rotation on a supporting body and positioned on such body so that the path of relative movement of the piston and cylinder elements is disposed in a plane substantially normal to the axis of rotation and is radially displaced from the axis of rotation. Such location of the piston and cylinder elements effects displacement of the movable one of such elements to a radially outward position as a consequence of centrifugal force generated by the rotation of the piston and cylinder assembly on the rotating body. A charge of pressured gas is introduced into the piston and cylinder assembly so as to cause a relative movement of the piston and cylinder elements in a direction in opposition to the centrifugal forces acting thereon. The gas pressure reaction force assists in driving the rotating body, while the concurrent expansion of the pressured gas results in a substantial cooling of the confined body of pressured gas. Hence, the moveable one of the piston and cylinder elements assumes a radially inner position at which point exhaust ports are traversed by the piston, permitting the expanded and cooled gas to be exhausted in a chamber defined by an enclosure shell which surrounds the rotating body and the piston and cylinder assemblage.

The apparatus disclosed in the aforementioned James G. Adams application then proposed to effect a compression of the expanded and cooled gas through the centrifugal action of the rotating chamber within which such cooled gas was discharged. Further experimentation has revealed the fact that excessively high rotational speeds of such rotating chamber would be required to effect the condensation of the cooled gas solely by centrifugal force. At the same time, the higher the rotational speed of the rotating body, the higher the pressure of the gas that must be supplied to the cooperating piston and cylinder elements in order to effect displacement of such elements against the ever increasing centrifugal forces.

There is a need, therefore, for improvement in the operating parameters of a heat extraction apparatus of the type disclosed in the aforementioned James G. Adams application which, while it permits a charge of heated pressured gas to be expanded and cooled while utilizing the energy of the gas to assist in the driving of the apparatus, will permit the cooled gas to be efficiently utilized as the cooling medium in an air conditioning or cooling system without requiring excessively high rotational speeds of the cooperating piston and cylinder assemblies. Furthermore, a cooling system using ordinary gases, such as air, would be very desirable.

SUMMARY OF THE INVENTION

The invention employs a rotating body mounted on a shaft driven by a suitable source of rotational power, such as an electric motor. At least one pair of piston and cylinder elements are mounted in diametrically opposed relationship on the rotating body and in such manner that the pistons are urged outwardly by centrifugal force to a position minimizing the fluid pressure chamber volume defined between the cylinder and the piston. A charge of pressured gas, which may be either a refrigerant fluid or ordinary air, is introduced into the fluid pressure chamber thru a timing valve as the pistons approach their radially outermost positions with respect to the cooperating cylinders. The expansion of such charge of pressured gas effects the relative movement of the pistons in a radially inward direction, thus substantially increasing the volume of the fluid pressure chamber and expanding and cooling the gas. The reaction forces of the expanding charge of gas contributes energy to the rotating body assemblage in a direction to assist in the rotation of such assemblage, thus reducing the energy requirements for the driving motor.

As the pistons reach the inward limits of their relative movements, a second valve is opened which permits the expanded cooled gas to be discharged from the cylinder chamber which is now at its maximum volume. The cooled gas is then directed into the inlet of a conventional heat exchanger, one form of which may comprise a plurality of axially extending tubes which are co-rotatable with the power shaft and conducts the cooled gases therethrough, reheating same, to a fluid conduit extending to the inlet of a compressor mounted on the power shaft. Such conduit may include a passage defined within the power shaft. The air to be cooled is moved by a separate motor driven fan and is directed through the rotating heat exchanger tubes to the room or chamber area where cooling is desired. The compressor receives the re-heated gas and compresses same to a level sufficient to insure the operation of the cooperating piston and cylinder assemblies against the centrifugal force acting on the pistons. The pressured fluid output of the compressor is then fed through a cooling apparatus, if required, and then fed as a new charge to the piston and cylinder elements through the timing valve which is open only as the pistons move to their radially outermost positions with respect to the rotational axis.

In accordance with a modification of this invention, the second valve for controlling the flow of the expanded cooled gases may also comprise a timing valve operable by relative movement of the pistons with respect to the cylinders. Such device may be opened during the entire outward stroke of the pistons produced by centrifugal force, thus assuring that the cooled expanded gases are forcibly driven into the heat exchanger and thence into the inlet of the rotary compressor.

When more than one set of rotating piston and cylinder elements are employed, such for example as two sets, a further embodiment of this invention provides timing valve arrangements for controlling the input of pressured gas to the respective sets of piston and cylinder elements so that the one set of piston and cylinder elements are energized by a new charge of pressured gas while the other pair of piston and cylinder elements are disposed at their radially inner positions and are exhausting the expanded and cooled gas. Thus the addition of rotational energy to the system resulting from the expansion of the gas charge occurs twice as often as when all of the cylinders are concurrently charged with pressured gas, thus reducing the cyclic variations in velocity of the rotating power shaft which is inherent in the first described arrangement.

A further modification of this invention employs air as the refrigerant fluid and discharges the cooled air into the room to be cooled through nozzles co-rotatable with the rotating piston and cylinder elements. Inlet air for the compressor is withdrawn from the same room.

Further objects and advantages of the invention will be readily apparent to those skilled in the art from the following detailed description, taken in conjunction with the annexed sheets of drawings, on which are shown several embodiments of the invention.

DESCRIPTION OF THE PREFERRED EMBODIMENTS

Figure 1:
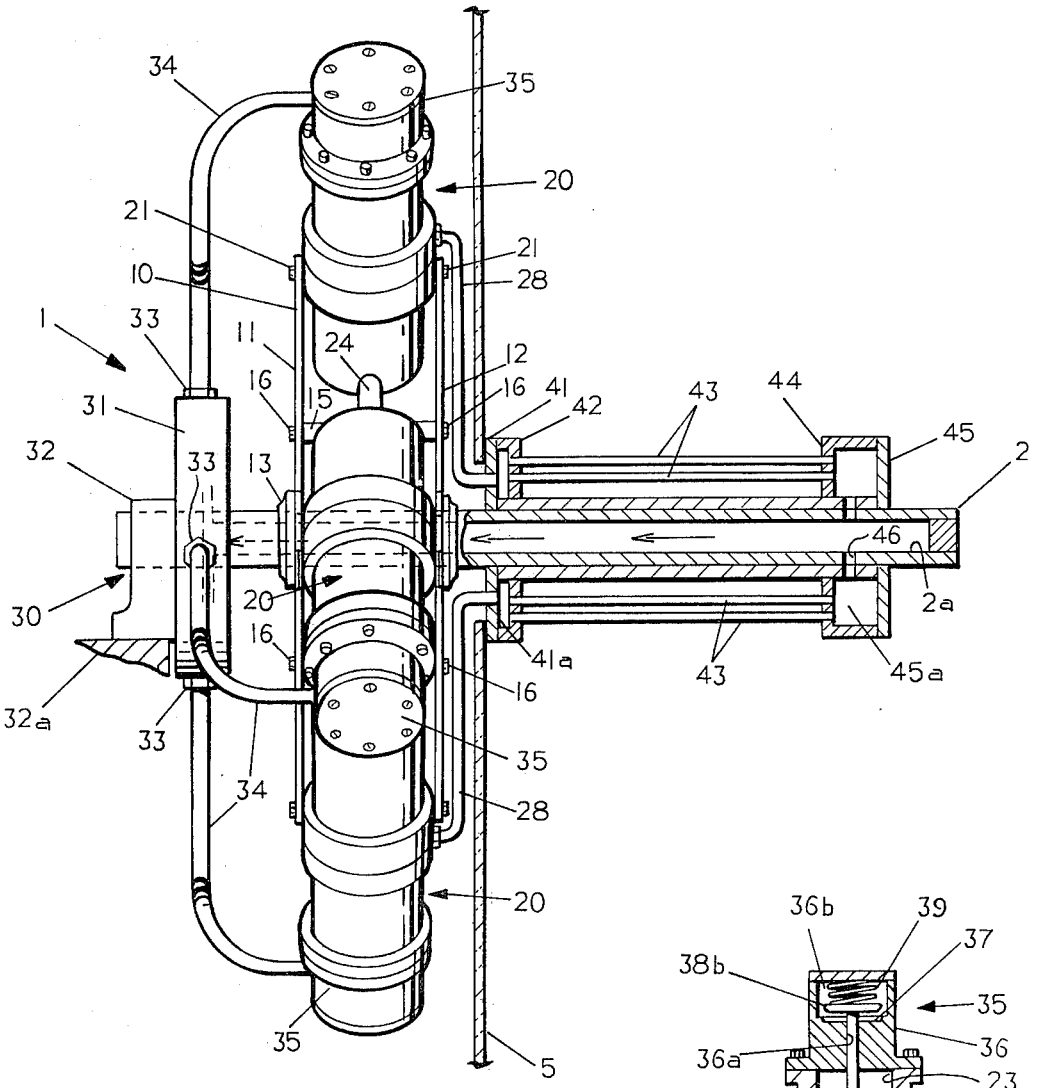
FIG. 1 is a schematic elevational view, partly in section, of an air cooling apparatus embodying this invention.
Figure 3:
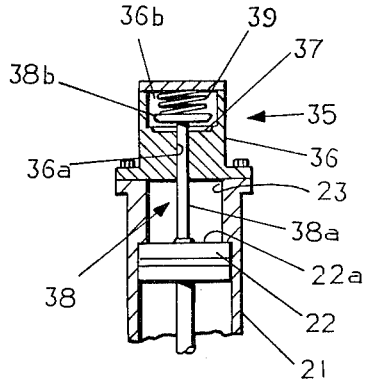
FIG. 3 is a partial sectional view of the end of one of the cylinder elements of FIG. 1.
Figure 2:
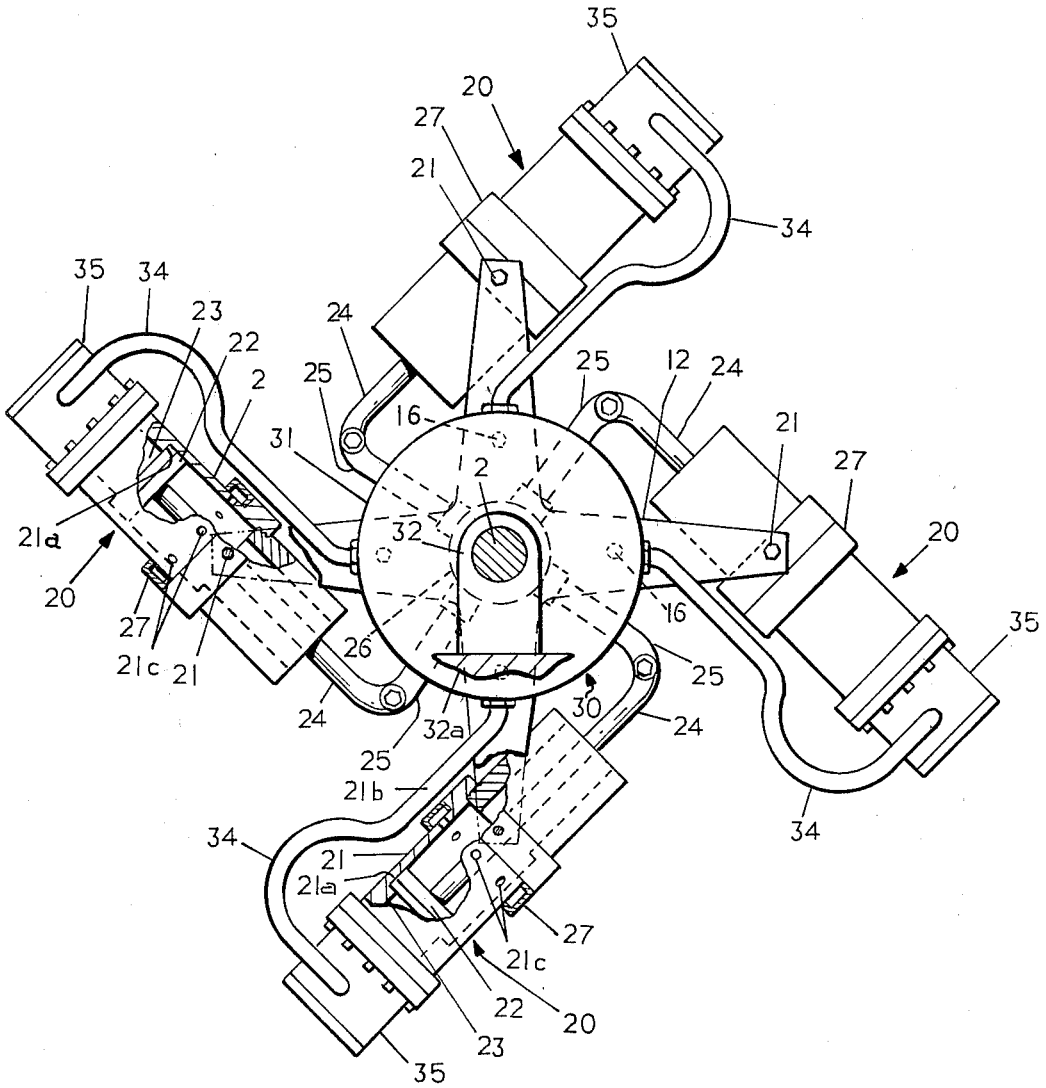
FIG. 2 is a side elevational view, partly in section, of FIG. 1.

Referring to FIGS. 1 through 3 there is schematically shown an air cooling apparatus 1 embodying this invention. Such apparatus comprises a hollow shaft 2 which is rotated by a suitable motor (not shown). A body 10 is co-rotatably secured to the hollow shaft 2. Body 10 may comprise two axially spaced, cruciform shaped plates 11 and 12 which are respectively secured to the shaft 2 for co-rotation by bushings 13. Plates 11 and 12 of body 10 are maintained in an axially spaced relationship by a plurality of spacing rods 15 which are respectively secured by bolts 16. At each of the four corners of the cruciform plates 11 and 12, a cylinder and piston element 20 is pivotally mounted as by bolts 21. Those skilled in the art will recognize that the number of such piston and cylinder elements employed is a matter of choice so long as the respective piston and cylinder elements 20 are equally peripherally spaced around the axis of rotation of the body 10 to maintain the dynamic balance of the assembly.

As best shown in FIG. 2, each piston and cylinder element 20 incorporates a cylinder 21 defining a fluid pressure chamber 23 within which a piston 22 is reciprocable. The path of reciprocation of each piston 22 is along a line that is radially spaced from the axis of rotation of the body 10 so that centrifugal force normally urges each piston 22 to a radially outward position relative to the cooperating cylinder element 21, thus minimizing the volume of the fluid pressure chamber 23. Each piston 22 is conventionally connected by a connecting rod 24 to the end of a crank rod 25. Cranks 25 are in turn rigidly secured to a hub 26 which is mounted for free oscillation about the hollow shaft 2. It should be particularly noted that the reciprocating movement of the pistons 22 is in no manner tied to the rotational movement of the hollow power shaft 2 beyond the fact the rotational movement of pistons 20 about the axis of rotation of power shaft 2 generates the aforementioned outwardly directed centrifugal force on each piston 22.

A compressor 30 is mounted on shaft 2. Compressor 30 may be any conventional form of rotary compressor having two relatively rotatable components, except that the compressor component 31 that normally contains the inlet and outlet fluid passages is co-rotatable with shaft 2 while the other component of the compressor 32 is stationarily mounted as schematically indicated at **32*a*. As will be later described, the inlet fluid for the compressor 30 is supplied from a port (not shown) in the hollow bore 2*a* of hollow shaft 2. The pressured fluid output of compressor 30 is transmitted through a plurality of pipe couplings 33 and conduits 34 to valving heads 35 respectively provided on the outer end of each of the piston and cylinder elements 20**.

As best shown in FIG. 3, each valving head 35 comprises an annular block 36 defining a central bore **36*a* and an enlarged valving chamber 36*b* communicating with such bore. A valve seat 37 is provided at the juncture of the central bore 36*a* and enlarged chamber 36*b*, and a stem type valve 38 cooperates with valve seat 37, being normally urged to a closed, sealing position by a heavy spring 39. Spring 39 will maintain valve 38 in closed position under maximum fluid pressure conditions in chamber 23**.

The stem valve 38 is provided with a stem 38*a* which extends into the interior of the fluid pressure chamber 23 and is engaged by the outer face 22*a* of piston 22 as such piston reaches its extreme outward position wherein it abuts an internal shoulder 21*a* defined within the cylinder 21. In such extreme outward position, the valve head 38*b* of the stem valve 38 is lifted from engagement with the valve seat 37. Thus, pressured fluid supplied from the compressor 30 through the conduit 34 is free to enter the fluid pressure chamber 23 and exert a force on the outward face 22*a* of piston 22, urging such piston to move inwardly against the centrifugal force bias holding it in such extreme outward position.

As soon as the fluid pressure force within the fluid pressure chambers 23 exceeds the centrifugal biasing force on pistons 22, the pistons 22 will begin to move inwardly towards the axis of the rotating power shaft 2, thus expanding the pressured gas contained in the fluid pressure chambers 23. After each piston 22 initiates its inward movement, the corresponding valve 38 is seated on the valve seat 37 through the action of the spring 39 and the charge of pressured gas is then trapped within the fluid pressure chamber 23. Such gas charge continues to expand and urge the piston 22 inwardly until it engages a second stop shoulder 21*b* provided in the cylinder 21. Obviously, such inward motion of the piston 22 produces an angular movement of the crank support hub 26.

In accordance with the embodiment of this invention illustrated in FIGS. 1 through 3, the expanded gas contained within the fluid pressure chamber 23 is exhausted at the end of the inward stroke of the piston 22 through the valving action of the piston 22 in uncovering a plurality of peripherally spaced exhaust ports 21*c* provided in the walls of cylinder 21. An annular header 27 is provided in surrounding relationship to the exhaust ports 21*c* and conducts the expanded, hence cooled charge of gas through a conduit 28 to the inlet of a heat exchanger 40 which is mounted in surrounding, co-rotatable relationship to the power shaft 2.

Heat exchanger 40 comprises a first end plate member 41 which receives the ends of the fluid conduits 28. Immediately adjacent to the end plate 41, there is secured a header 42 which provides a mounting for a plurality of peripherally spaced, axially extending tubes 43 which have their opposite ends mounted in a header 44 generally similar to the header 42. A second end plate 45 is secured to the second header 44. Annular chambers 41*a* and 45*a* are respectively defined between the end plate 41 and header 42, and end plate 45 and header 44. Chamber 45*a* is connected to the bore 2*a* of hollow shaft by radial ports 46, thus permitting the reheated gas to flow through the bore 2*a* of hollow shaft 2 to the inlet (not shown) of the compressor 30.

To employ the described apparatus as an air cooling or air conditioning device, it is only necessary to provide suitable duct work and a fan for moving a stream of warm air laterally across the rotating heat transfer tubes 43. Rather than showing such conventional duct work, the flow of the air to be cooled has been schematically indicated by arrows and legends on FIG. 1.

The operation of the aforedescribed apparatus will be readily apparent to those skilled in the art. A closed circuit flow of a suitable refrigerant fluid is defined by the described apparatus. Starting with the outlet nipples 33 of the compressor 30, such flow extends to the valving heads 35 provided on the outer ends of each of the piston and cylinder assemblies 20. When the stem valve 38 is elevated to its open position by the piston 22 arriving at its extreme radially outward position, a charge of pressured gas is fed into the fluid pressure chamber 23 defined within each cylinder 21. Such charge of pressured gas effects the axial displacement of the pistons 22 toward a radially inner position relative to the rotational axis of power shaft 2, against the opposition of the centrifugal force imparted by the rotation of the piston and cylinder assemblies 20 about such axis. Pistons 22 concurrently move inwardly due to the fact that they are interconnected by connecting rods 24 and the cranks 25 mounted on the crank support sleeve 26. Thus the rotating assemblage always remains in dynamic balance.

When each piston 22 arrives at its innermost position as determined by the stop shoulder 21*b*, the exhaust ports 21*c* are opened and the expanded cooled gas is supplied through the annular header 27 and conduits 28 to the inlet side of the heat exchanger 40. The suction exerted by compressor 30 aids this gas movement. The expanded cooled gas passes through the heat transfer tubes 43 of heat exchanger 40, absorbing heat from the room air passing thereover, and is heated thereby. The reheated gas is directed through the outlet ports 46 into the bore 2*a* of the hollow power shaft 2, and then into the fluid inlet of the compressor 30.

The particular advantage of the aforedescribed system is that during the expansion movement of each piston 22 by the charge of pressured gas, the reaction force of the expanding gas is exerted on the outboard end of the piston and cylinder assemblies 20 and this force is in a direction to aid in the rotation of the power shaft 2. Thus, the energy requirements for operating this system are substantially reduced due to the extraction of mechanical energy from the expansion force of the pressured gas.

More importantly, it is not essential for the successful operation of such system to use a refrigerant fluid such as Freon, although such fluid could be employed if desired, or to effect a gas to liquid to gas phase change. A significant cooling action may be achieved through the utilization of ordinary air as a refrigerant fluid and hence the term "refrigerant fluid" utilized in the claims should be deemed to include any gas, including air, but preferably a gas that is non-explosive and has no adverse environmental effects if accidentally leaked into the atmosphere.

Those skilled in the art will recognize that the aforedescribed apparatus will only effect a predetermined range of reduction in temperature of the refrigerant gas which is determined primarily by the amount that the gas is expanded. If the purpose of the apparatus is to effect room cooling, and the range of temperature reduction is on the order of 30° F., then obviously, the temperature of the pressured gas entering the plurality of piston and cylinder elements 20 must not be in excess of 100° F. or less to provide any effective amount of room cooling.

It is also obvious that the action of the compressor 30 in compressing the reheated gas will inherently increase the temperature of the gas. Accordingly, in most instances, it will be necessary to physically locate the compressor 30 and the driving motor for power shaft 2 in a separate room or chamber that is separated from the chamber to be cooled by a suitable wall of heat insulating material. Since the piston and cylinder elements 20 are rotating, such wall may most conveniently be located between the rotating body 10 and heat exchanger 40 as indicated schematically by the numeral 5 in FIG. 1.

It may also be necessary to run the compressed gas exiting from the compressor 30 through a heat exchange type cooling device and this device should be located on the side of the heat insulating barrier 5 opposite to the heat exchanger 40. The fan (not shown) for any such gas cooling heat exchanger can, of course, be driven by power shaft 2.

Figure 4:
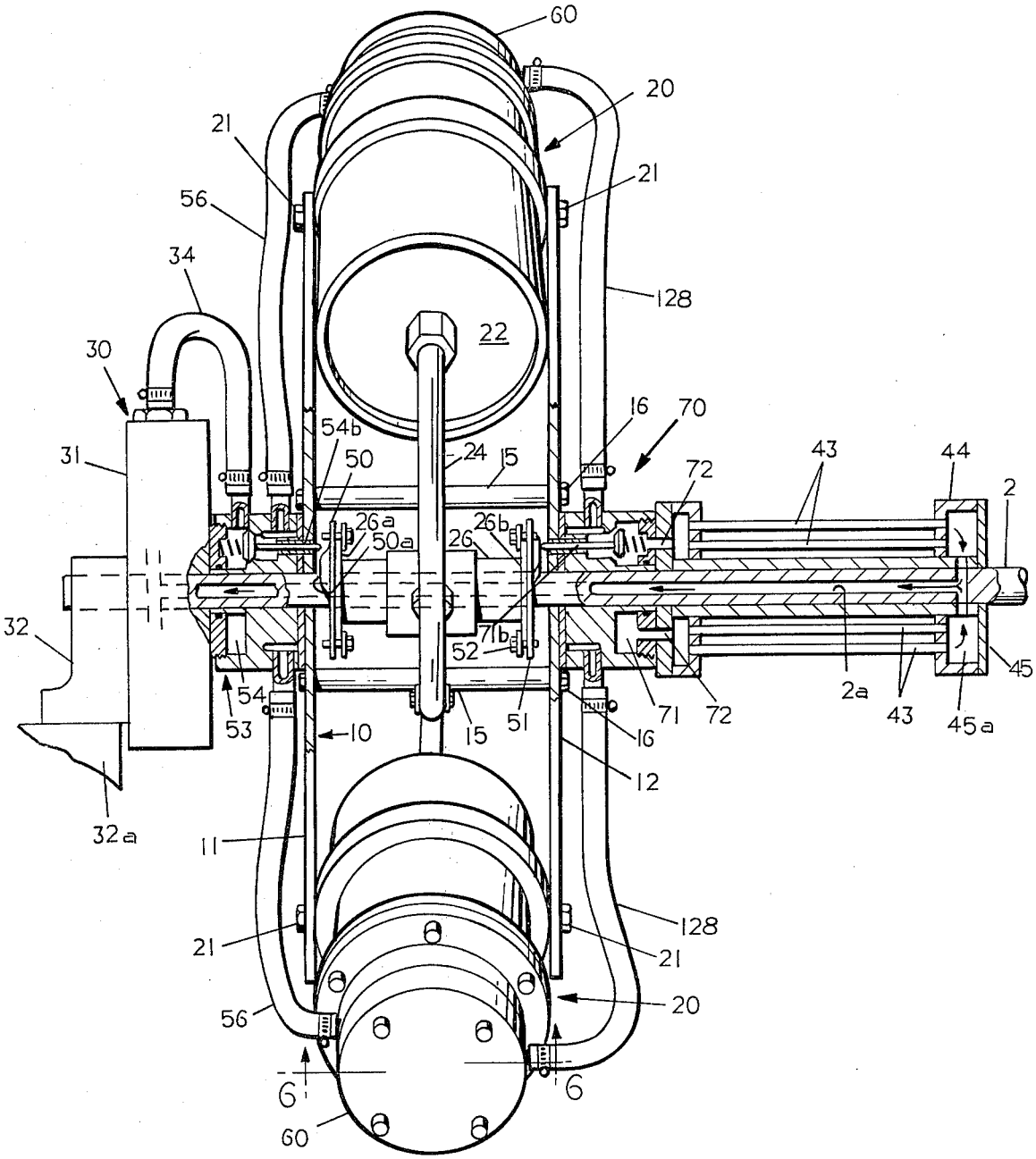
FIG. 4 is a schematic, elevational view, partly in section, of a modified gas cooling apparatus embodying this invention employing timing valves operated by the relative positions of the pistons and cylinders.

Referring now to FIG. 4, wherein similar numerals indicate parts identical to those previously described, there is shown another embodiment of this invention employing timing valves actuated by the oscillating movements of the crank support hub 26 to not only control the supply of pressured fluid to the fluid pressure chambers 23 of the piston and cylinder elements 20, but also to control the exhausting of the cool expanded gas from the fluid pressure chambers 23 during the return outward stroke of the pistons 22. While only two piston and cylinder assemblies 20 are specifically shown in FIG. 4, it should be understood that more than two of such units are normally employed, but the additional units are not shown in order to permit the drawings to clearly show the modified valving arrangement.

On the end of the crank support hub 26 adjacent body wall 11, a radial flange **26*a* is provided. An annular cam plate 50 is secured to hub flange 26*a* bolts 52. Cam plate 50 is provided with an axially projecting camming protuberance 50*a***.

Figure 5:
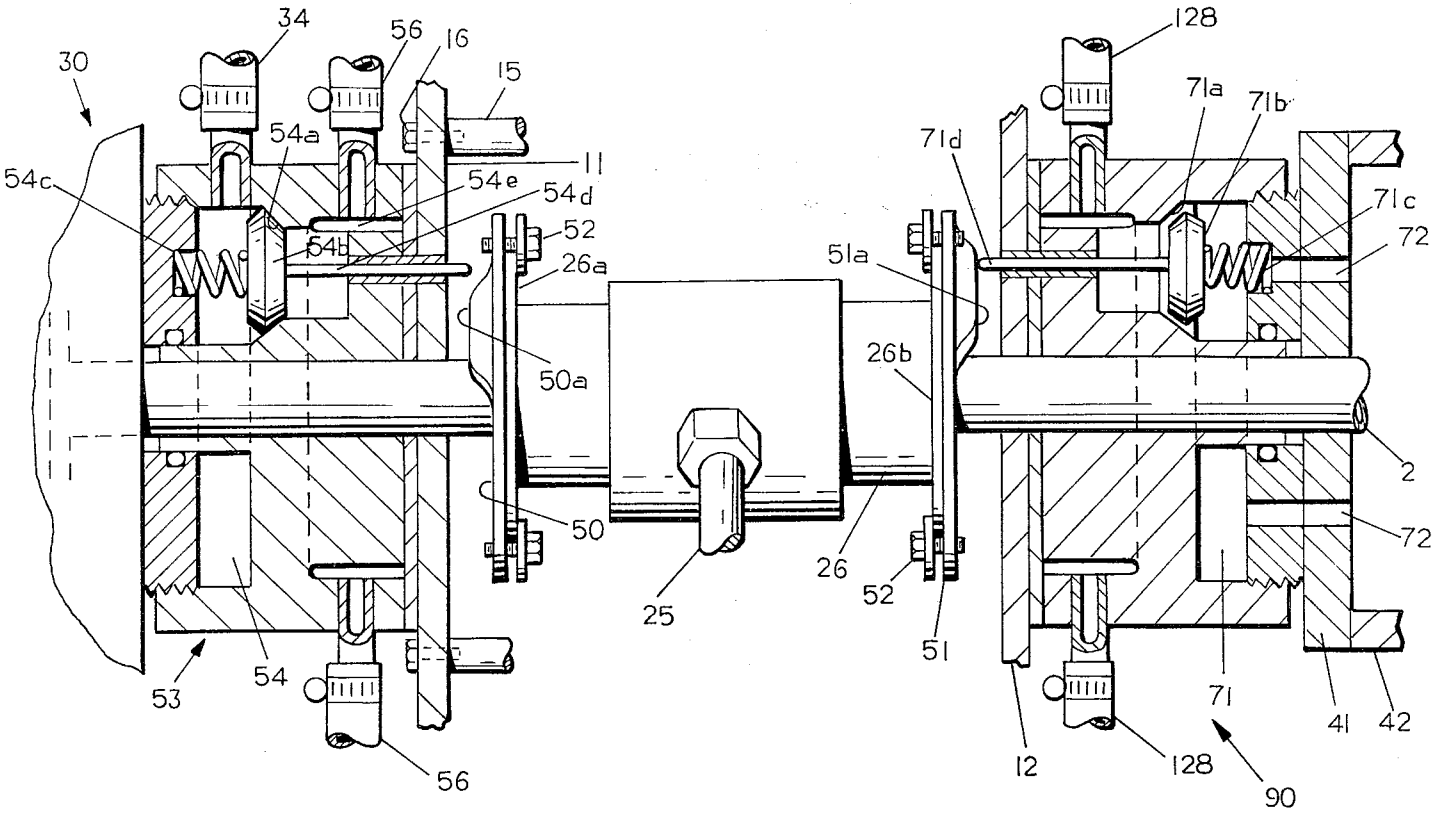
FIG. 5 is an enlarged scale, sectional view of the valving apparatus employed in FIG. 4.

An inlet timing valve block 53 is secured to the outer face of the plate 11 of rotating plate 10. Valve block 53 defines a valving chamber 54 (FIG. 5). Valving chamber 54 defines a valve seat **54*a* with which a stem valve 54*b* cooperates. Stem valve 54*b* is normally urged into sealing position with respect to the valve seat 54*a* by a spring 54*c*. A stem portion 54*d* of the stem valve 54*b* projects through a suitable opening in the valve block 53 and in the side wall 11 of body 10 to be engaged by the camming protuberance 50*a* provided on the cam plate 50. Conduits 34 extending from the discharge side of the compressor 30 are respectively connected to the valve block 53 in fluid communication with valve chamber 54. Outlet manifold 54*e* of valve block 54 connects with conduits 56 which extend to inlet housings 60 respectively provided on the other ends of the piston and cylinder assemblies 20 in place of the valve blocks 35 utilized in the modification of FIGS. 1–3. Each inlet housing 60 merely defines a direct fluid connection to the fluid pressure chamber 23 of the respective cylinder 21**.

The remainder of the apparatus of FIG. 4 may be the same as described in connection with the modification of FIGS. 1–3. The cooled expanded gas could be discharged from the radial ports **21*c* when the pistons 22 reach their extreme inner position, and then conducted through annular header 27 and conduits 28 to the inlet of the heat exchanger 40. The reheated gas would be directly by conduits 46 into the bore 2*a* of the hollow shaft 2, from which it returns to the inlet side of the compressor 30. The pressured fluid output of compressor 30 is supplied to valve chamber 54 and thence concurrently to piston and cylinder elements 20**.

Alternatively, FIG. 4 illustrates a further embodiment of this invention wherein a timing valve is employed to control the discharge of cooled expanded gas from the respective fluid pressure chambers 23 during most of the return outward stroke of the pistons 22. The arrangement has the advantage that the cooled gas is placed under a positive pressure as it flows to the heat exchanger 40, rather than relying upon the suction pressure of the compressor 30 as is the case in the modifications heretofore described.

A second radial flange **26*b* is provided on the opposite end of the crank support hub 26 and mounts a camming plate 51 by suitable bolts 52. Camming plate 51 is provided with an axially projecting camming protuberance 51*a*. A timing valve block 70 is suitably secured to the outer face of the side wall 12 of the rotating body 10. Valve block 70 is functionally similar to the valve block 53 and defines a valving chamber 71. Chamber 71 incorporates a valve seat 71*a* with which a stem valve 71*b* cooperates under the bias of a spring 71*c*. The stem 71*d* of the stem valve 71*b* projects through suitable openings in the valve block 70 and the side wall 12 of the rotating body to be periodically engaged by the camming protuberance 51*a* as the crank support hub 26 oscillates with respect to the rotating power shaft 2**.

Figure 6:
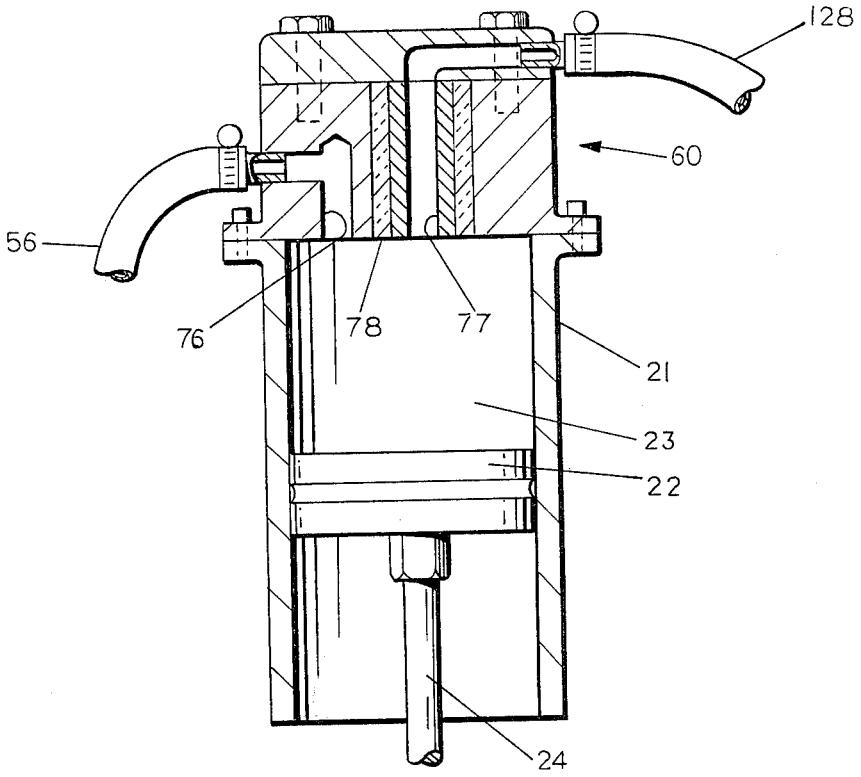
FIG. 6 is an enlarged scale, sectional view taken on the plane 6—6 of FIG. 4.

The inlet portions of valving chamber 71 are respectively connected by conduits 128 to a fluid control head 60 which is secured to the outer end of each of the cylinders 22 in place of the valving head 35 utilized in the previous modifications. As best shown in FIG. 6, fluid control head 60 incorporates a pair of fluid passages 76 and 77 respectively connected to the conduits 56 supplying pressured gas, and the cooled gas conduits 128 which run to valve chamber 71. Passage 77 may be surrounded by a sleeve 78 of insulating material mounted in fluid control head 60. When stem valve **71*b* is open, the cooled gas flows through conduit 128 to the inlet of heat exchanger 40**.

In operation, the outlet valve **71*b* is normally maintained in its closed position during the charging of the fluid pressure chambers 23 of the cylinders 21 with pressured gas and throughout the inward power stroke of the pistons 22. As the pistons 22 start on their return, outward stroke, the corresponding stem valve 71*b* is engaged by the camming protuberance 51*a* and shifted to an open position. Thus the outward return stroke of the pistons 22 is employed to positively force the cooled expanded gas through ports 72 into the inlet of the heat exchanger 40**. From that point, the circulation of the refrigerant gas is the same as heretofore described in connection with the other modifications of this invention.

Figure 7:
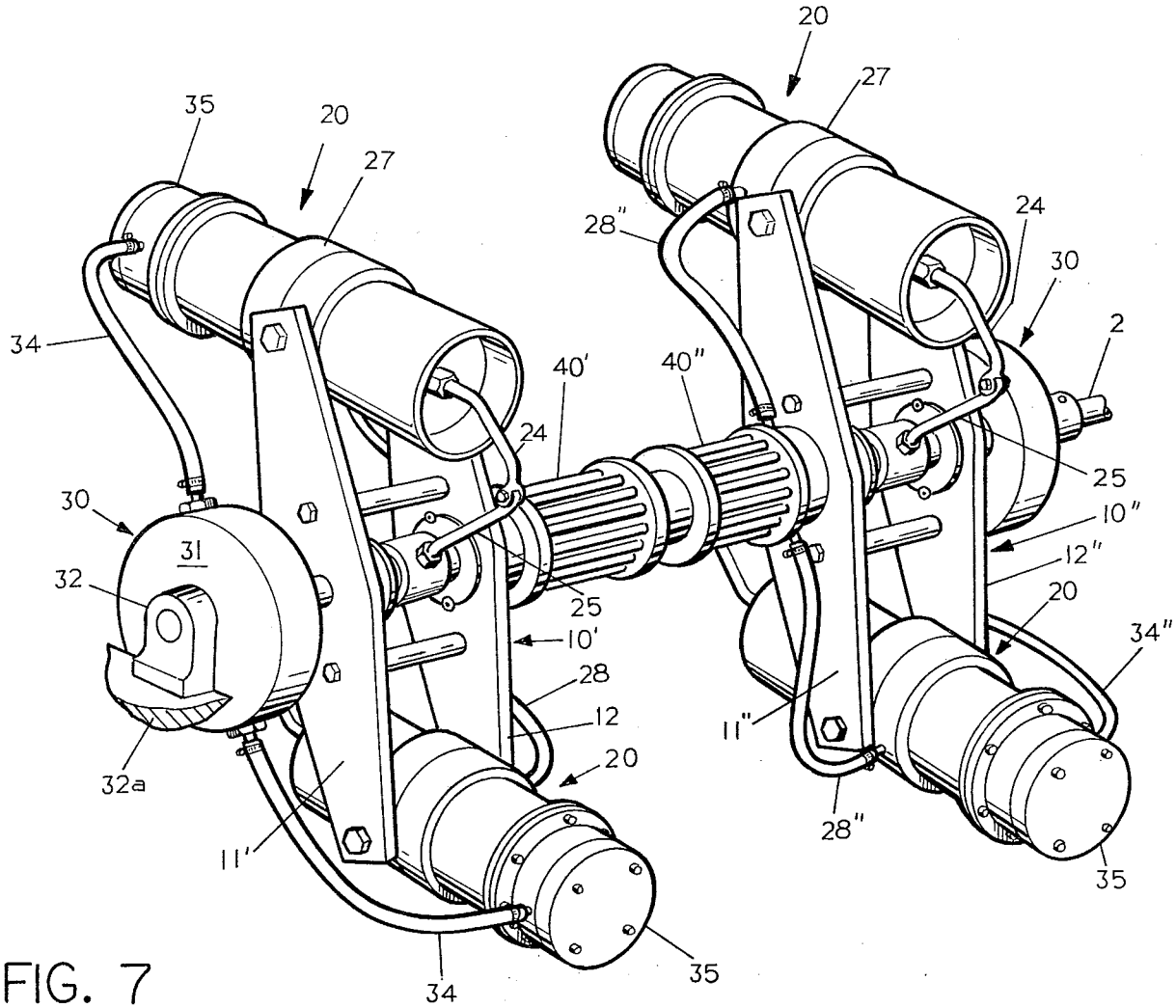
FIG. 7 is a schematic perspective view of a further modification of this invention wherein a plurality of sets of piston and cylinder elements are disposed in axially spaced relation along the power shaft.

Referring now to FIG. 7, a further embodiment of this invention is illustrated wherein a plurality of sets of piston and cylinder elements are mounted on the rotating power shaft 2 in axially spaced relationship. Similar numbers indicate parts identical to those previously described. For simplicity of illustration, only one pair of piston and cylinder elements 20 are shown at each axial location on the rotating power shaft 2. The two pairs of piston and cylinder elements 20 are respectively mounted on separate body elements 10′ and 10″, respectively, comprising axially spaced rectangular plates 11′ and 12′, and 11″ and 12″. A compressor 30 is mounted on the rotating power shaft 2 adjacent the body element 10′. Compressor 30 is identical to that element previously described in the modification of FIGS. 1–3 and receives gases at its inlet from the bore **2*a* of the rotating power shaft 2 and discharges the pressured gas through conduits 34 on the ends of piston and cylinder elements 20 which respectively extend to valving heads 35** of the type heretofore described in connection with the modification of FIGS. 1–3. The cooled expanded gases are discharged through radial ports 21*c* (FIGS. 1–3) in the cylinder elements 21 into an annular header 27 and respectively connected by conduits 28 to the inlets of a heat exchanger apparatus 40′ which is functionally identical to the element 40 of the modification of FIGS. 1–3.

The second pair of piston and cylinder elements 20 that are mounted on rotating body element 10″ are supplied with pressured gas from another compressor 30, identical to that previously described, mounted on the rotating power shaft 2 and having pressure fluid outlets connected by conduits 34″ to the valving heads 35 provided on such piston and cylinder elements 20. The expanded cooled gas from the second pair of piston and cylinder elements 20 are directed by conduits 28″ to the inlet end of a heat exchanger unit 40″ which is functionally identical to the heat exchanger element 40′ but is disposed in mirror image reversed relationship. In other words, the two heat exchanger elements 40′ and 40″ provide a flow of the cooled air axially from each end to the center where it is collected in an annular chamber and conducted to the bore 2*a* of the rotating power shaft 2 by radial ports, and thence to the inlets of the compressors 30.

The operation of the modification of FIG. 7 is identical to that described for the modification of FIGS. 1–3, the only exception being that the two sets of diametrically opposed piston and cylinder elements 20 are axially spaced relative to each other. Obviously, the rotating body elements 10′ and 10″ could be formed in the cruciform configuration described in connection with the modification of FIGS. 1–3 and four cooperating piston and cylinder elements 20 could then be mounted on each rotating body element 10′ and 10″.

Those skilled in the art will recognize that a single compressor unit could be employed to supply pressured gas to both of the axially spaced set of piston and cylinder elements 20 through the provision of additional piping, but since such piping would be rotating and would be disposed in surrounding relationship to the heat exchangers 40′ and 40″, directing the air to be cooled through the heat exchangers, yet avoiding such additional piping, presents a difficult design problem.

Figure 8:
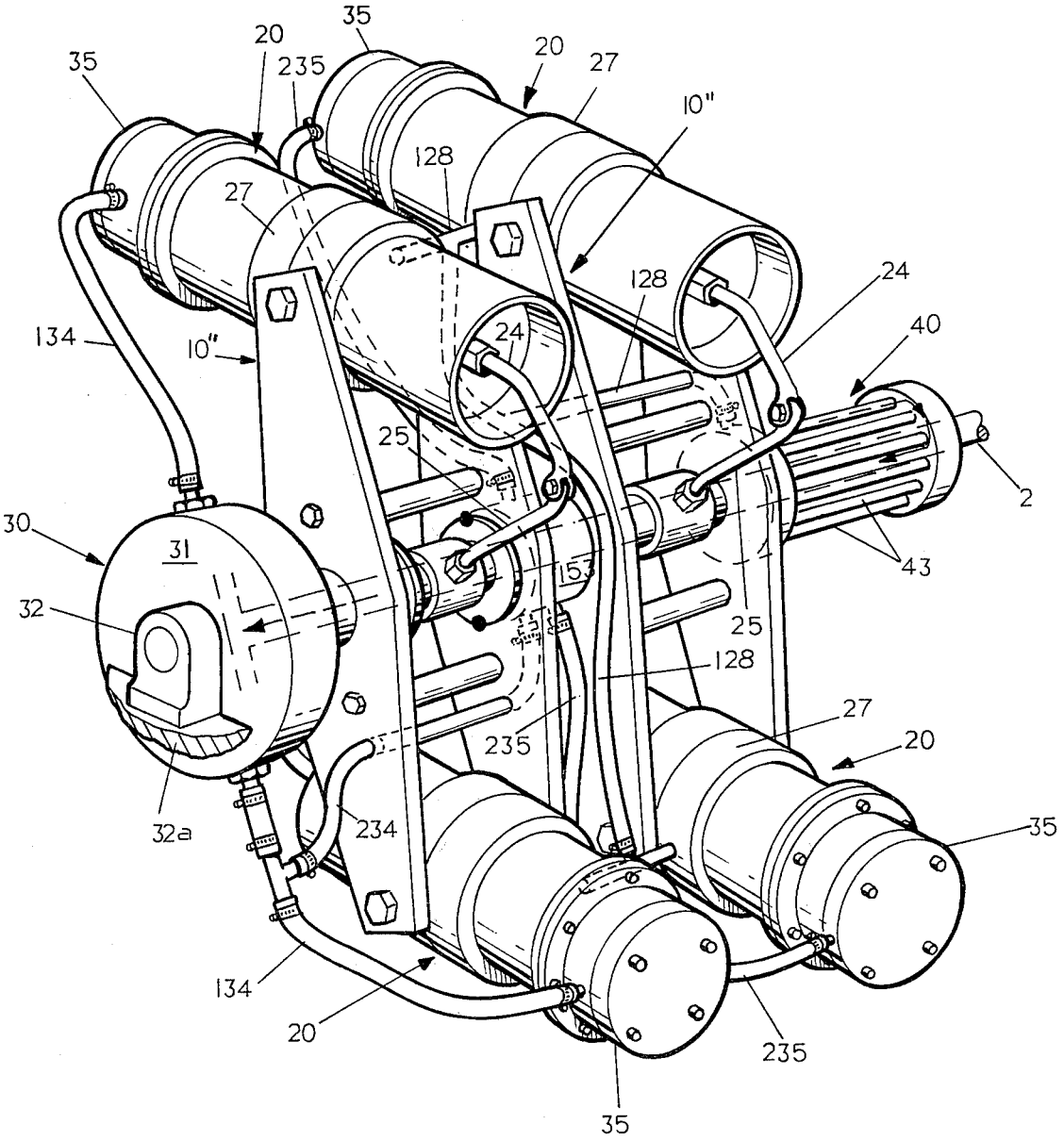
FIG. 8 is a schematic perspective view of a further embodiment of this invention utilizing axially displaced sets of piston and cylinder elements that are sequentially energized.
Figure 9:
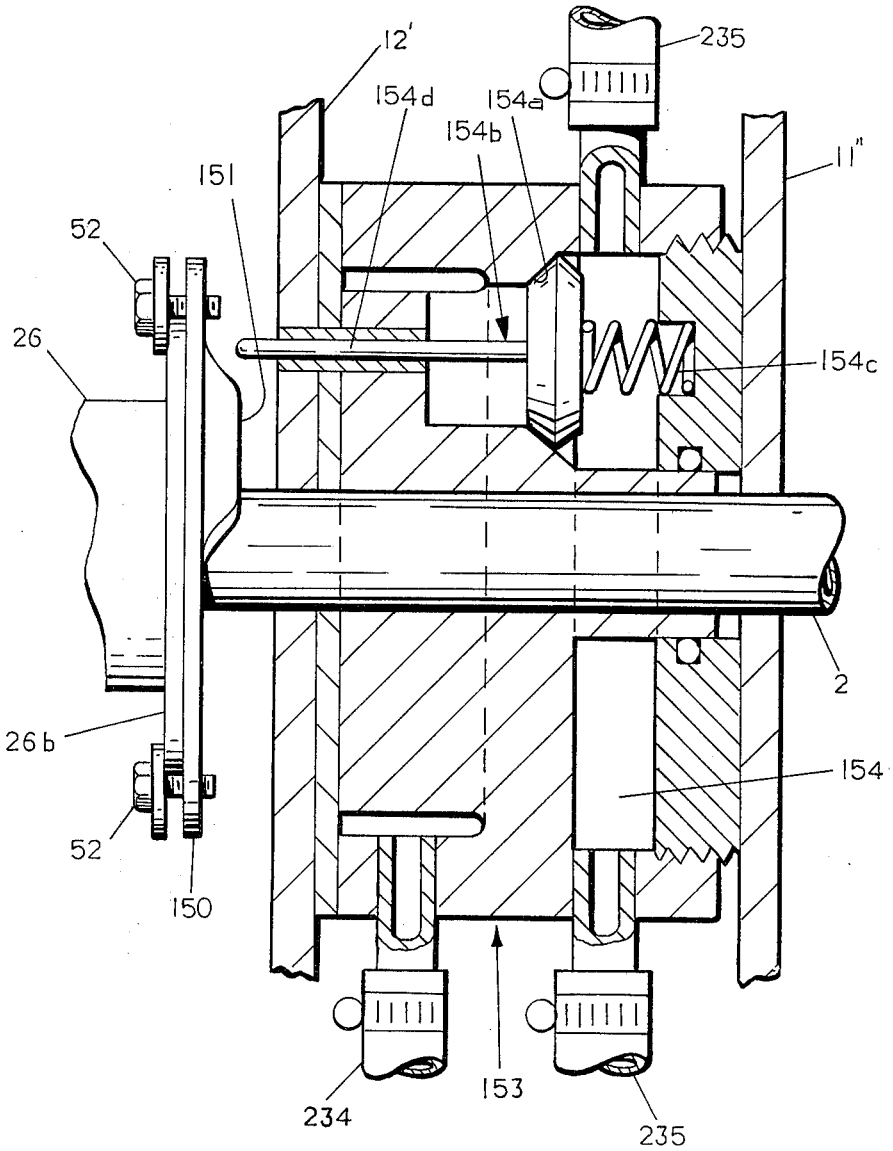
FIG. 9 is an enlarged scale, partial sectional view of a timing valve utilized in the apparatus of FIG. 8.

The modification of this invention illustrated in FIGS. 8 and 9 not only solves the design problem encountered in the employment of a single compressor to drive two axially displaced sets of rotating piston and cylinder elements 20, but also permits the energization of the pistons of the two axially displaced sets to be phase displaced by any desired amount but preferably 180°, so that one set of pistons is being energized by pressured fluid in the outermost position of the pistons when the other axially displaced set of pistons are disposed in their innermost or exhaust position.

Referring now to FIG. 8, where similar numerals represent structure identical to that previously described in connection with the other modifications of this invention, two axially displaced sets of piston elements are respectively mounted on the rotating power shaft 2 by rotating bodies 10′ and 10″. Both sets of piston and cylinder elements are equipped with valving heads 35 as described in connection with the embodiment of FIGS. 1–3. Conduits 134 extend directly from the outlets of compressor 30 to each of the valve heads 35 of the first set of piston and cylinder elements. Pressured gas for the second set is supplied through conduit 234, a timing valve block 153, and conduits 235.

Valve block 153 is secured to the outer face of the plate 12′ of rotating body 10′. Valve block 153 is identical to the valve block 53 heretofore described, but is, for obvious reasons, disposed in mirror image reversed relationship with respect to the valve block 53. The valve block 153 (FIG. 9) incorporates a valving chamber 154 which defines a valve seat 154*a*. A stem valve 154*b* cooperates with valve seat 154*a* and is biased to sealing relationship therewith by a spring 154*c*. A stem portion 154*d* of the stem valve 154*b* projects through a suitable opening in the valve block 153 and through the side wall 12′ of body 10′. A camming protuberance 151 on piston oscillated cam plate 150 cooperates with stem valve 154*b* in the same manner as heretofore described, to periodically open such valve. Camming protuberance 151 is preferably angularly located to open stem valve 154*b* only when the pistons 22 of the first set of piston and cylinder elements 20 are located in their innermost positions.

Conduits 235 extend from the outlet side of valve block 153 to valving heads 35 provided on the second set of piston and cylinder elements 20. These valving heads 35 function in the manner described in connection with FIGS. 1–3. Hence the first and second sets of pistons 22 are sequentially energized, thus reducing the velocity fluctuations of power shaft 20.

Fluid discharge from each of the piston and cylinder elements 20 is through side wall ports 21*c* (FIGS. 1–3), annular headers 27 and conduits 128, which respectively extend from each annular header 27 to the inlet plate 41 of the heat exchanger 40 which is identical to that previously described. Heat exchanger 40 is mounted on the side of the second rotating body 10″ opposite to the position of the first rotating body 10′. The cooled expanded gases produced by the operation of the piston and cylinder elements 20 pass through the heat exchange tubes 43 of heat exchanger 40, thence into collecting chamber 45*a* (FIG. 1) and into the bore 2*a* of the rotating power shaft 2 through radial ports 46, as heretofore described. From shaft bore 2*a*, the reheated gases pass into the inlet of the compressor 30 for recompression and reapplication to the rotating piston and cylinder elements 20.

In addition to simplifying the application of the air stream to be cooled by heat exchanger 40, the embodiment of FIGS. 8 and 9 has the further advantage that the employment of the additional timing valve block 153 to control the application of fluid pressure to the piston and cylinder elements 20 of the second set of the two axially displaced sets of such elements, permits the power stroke of the pistons in the one set of elements to be timed so that they are actuated in a phase displaced relationship to the piston elements in the second set. Preferably the phase displacement is 180° such that pressured gas is applied to the one set of piston and cylinder elements 20 at the same time that the pistons of the other set of piston and cylinder elements are at their radially inward or exhaust position. In this manner, the mechanical energy input to the power shaft 2 produced by the reaction forces of the expanding gas and the various fluid chambers 23 is caused to occur sequentially, rather than concurrently, and hence the cyclic variation in velocity of the rotating power shaft 2 is significantly reduced. Also, the input of cooled gas to heat exchanger 40 occurs sequentially, minimizing temperature fluctuations of heat exchanger 40.

In all modifications of the invention, the reaction force on the cylinders 21 produced by the expanding gas contributes to maintaining the rotating velocity of the power shaft 2 and hence substantially diminishes the energy requirements of the system. Moreover, those skilled in the art will recognize that any conventional gas, including air, may be utilized as the refrigerant fluid and that phase conversion of such gas to liquid and back again is not necessarily required for the successful operation of the described system.

Figure 10:
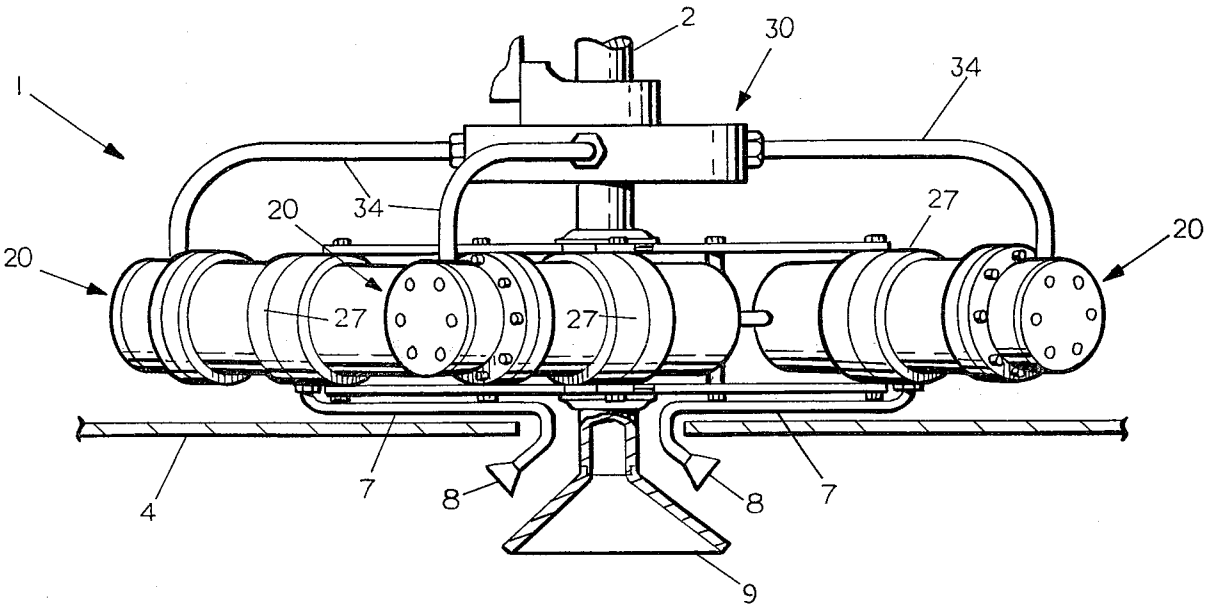
FIG. 10 is a schematic elevational view, partly in section, of an open cycle room cooling version of the invention.

When air is employed as the refrigerant fluid in an apparatus 1 embodying this invention, it is not necessary that a closed cycle be provided for the air. Thus, as best shown in FIG. 10, the cooled air discharged from the fluid pressure chambers 23 through annular headers 27 may be directed into the room areas to be cooled by conduits 7 and nozzle elements 8 which are, of course, rotating. With such an arrangement, a very efficient distribution of the cool air into the room area can be achieved by mounting the power shaft 2 in a vertical position adjacent to the ceiling 4 of the room and disposing the remainder of the apparatus 1, namely the driving motor (not shown), the compressor 30, and the plurality of rotating piston and cylinder elements 20 above the ceiling 4 of the room to be cooled. Return air may be conveniently picked up by the open end of the power shaft 2 on which a conical baffle 9 is mounted.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. Air cooling apparatus comprising, in combination: a rotatable body; power means for rotating said body; a cylinder element defining a fluid pressure chamber; a piston element cooperable with said fluid pressure chamber; means for mounting one of said elements on said rotatable body at a position radially spaced from the axis of rotation of said rotatable body, whereby centrifugal force produces relative movement of said piston element in said fluid pressure chamber in a direction to reduce the volume of said fluid pressure chamber; a first valve means communicating with said fluid pressure chamber and openable only when said piston element approaches the minimum volume position relative to said fluid pressure chamber; a second valve means communicating with said fluid pressure chamber openable only when said piston is remote from said minimum volume position relative to said fluid pressure chamber; one said valve means being closed whenever the other said valve means is open; a room air heat exchanger having refrigerant fluid passages therethrough; a compressor co-rotatable with said hollow body; and conduit means for circulating a refrigerant fluid from said second valve means, through said refrigerant fluid passages of said heat exchanger, to the inlet of said compressor and from the outlet of said compressor to said first valve means.

2. Air cooling apparatus comprising, in combination: a rotatable body; power means for rotating said body; a cylinder element defining a fluid pressure chamber; a piston element cooperable with said fluid pressure chamber; means for mounting said cylinder on said rotatable body at a position radially spaced from the axis of rotation of said rotatable body whereby centrifugal force produces relative movement of said piston element in said fluid pressure chamber in a direction to reduce the volume of said fluid pressure chamber; a first valve means communicating with said fluid pressure chamber and openable only when said piston element approaches the minimum volume position relative to said fluid pressure chamber; a second valve means communicating with said fluid pressure chamber and openable only when said piston is remote from said minimum volume position relative to said fluid pressure chamber; a room air heat exchanger having refrigerant fluid passages therethrough; a compressor co-rotatable with said hollow body; and conduit means for circulating a refrigerant fluid from said second valve means, through said refrigerant fluid passages of said heat exchanger, to the inlet of said compressor and from the outlet of said compressor to said first valve means.

3. The apparatus of claim 1 or 2 wherein said first valve means comprises a check valve mounted in the axial end of said cylinder, resilient means urging said check valve to closed position, and an actuating stem on said check valve extending into said fluid pressure chamber and engageable by said piston element to open said check valve as said piston moves to said minimum volume position relative to said fluid pressure chamber.

4. The apparatus of claim 1 or 2 wherein said heat exchanger comprises an assemblage of tubes parallel to said rotation axis and co-rotatable with said rotatable body, said tubes defining said refrigerant fluid passages.

5. The apparatus of claim 1 or 2 wherein said rotating body is mounted on a hollow shaft, and the bore of said hollow shaft forms part of said conduit means.

6. The apparatus of claim 1 or 2 wherein said body comprises a pair of axially spaced plates secured to a rotatable shaft, and said cylinder and piston elements are mounted between said plates.

7. Air cooling apparatus comprising, in combination: a hollow shaft mounted for rotation; a body secured to said shaft for co-rotation; power means for rotating said shaft; a plurality of cooperating piston and cylinder elements mounted on said body in an equi-spaced array about the axis of rotation; each cylinder element defining a fluid pressure chamber in which the respective piston element is shiftable by centrifugal force in a direction to reduce the volume of said fluid pressure chamber; a first valve means communicating with each said fluid pressure chamber and openable only when the respective piston element approaches the minimum volume position relative to said fluid pressure chamber; a second valve means communicating with each said fluid pressure chamber and openable only when the respective piston is remote from said minimum volume position relative to said fluid pressure chamber; a room air heat exchanger having refrigerant fluid passages therethrough; a compressor co-rotatable with said hollow shaft; and conduit means for circulating a refrigerant fluid from each said fluid pressure chambers, through said second valve means, through said refrigerant fluid passages, through the bore of said hollow shaft to the inlet of said compressor, from the outlet of said compressor to each said first valve means and through said first valve means to said fluid pressure chambers.

8. The apparatus of claim 7 wherein each said first valve means comprises a check valve mounted in the axial end of the respective cylinder, resilient means urging said check valve to closed position, and an actuating stem on said check valve extending into said fluid pressure chamber and engageable by the respective piston element to open said check valve as the respective piston moves to said minimum volume position relative to said fluid pressure chamber.

9. The apparatus of claim 7 wherein said heat exchanger comprises an assemblage of tubes parallel to the axis of rotation and co-rotatable with said rotatable body, said tubes defining said refrigerant fluid passages.

10. The apparatus of claim 7 wherein said body comprises a pair of axially spaced plates secured to said hollow shaft, and said cylinder and piston elements are mounted between said plates.

11. The apparatus of claim 7 wherein said room air heat exchanger is disposed on one axial side of said body and said compressor is disposed on the opposite side.

12. The apparatus defined in claim 7 wherein said plurality of cooperating piston and cylinder elements comprise two pairs of two elements diametrically opposed relative to said axis of rotation; means interconnecting said piston elements of each pair for co-movement in the respective cylinders; and said first valve means comprises a pair of timing valves operable in response to linear movements of one pair of pistons, each said timing valve being series connected in said conduit means to control the application of pressured fluid from said compressor to a respective pair of said cylinders, whereby the pistons of one pair are moved in 180° phase displacement relative to the pistons of the other pair.

13. Air cooling apparatus in accordance with claim 1, 2, 7, 10 or 12 wherein each said cylinder has an inlet passage for receiving hot pressured gas and an outlet passage for discharging cooled expanded gas, and heat insulating means separating said passages.

14. Air cooling apparatus comprising, in combination: a hollow shaft mounted for rotation; a body secured to said shaft for co-rotation; power means for rotating said shaft; a pair of cylinders mounted on said body in diametrically opposed relation and respectively defining cylindrical fluid pressure chambers having axes radially spaced from the rotational axis of said body; a pair of pistons respectively cooperable with said cylinders and movable by centrifugal force to reduce the volume of the respective fluid pressure chambers to a minimum; an annular crank support journalled on said hollow shaft; a pair of crank arms secured to said annular crank support; connecting rod means respectively connecting said crank arms to said pistons, whereby said annular crank support is oscillated by the reciprocal movement of said pistons; a first fluid valve operable by said annular crank support to an open position only when said pistons approach said minimum volume position; a second fluid valve operable by said annular crank support to an open position only when said pistons are moving from their maximum volume position to said minimum volume position and said first valve means is in a closed position; a room air heat exchanger having refrigerant fluid passages therethrough; a compressor co-rotatable with said hollow shaft; and conduit means for circulating refrigerant fluid from each said fluid pressure chambers, through said second valve, through said refrigerant fluid passages, through the bore of said hollow shaft to the inlet of said compressor, from the outlet of said compressor to said first valve and through said first valve to said fluid pressure chambers.

15. The apparatus of claim 14 wherein said heat exchanger comprises an assemblage of tubes parallel to the axis of rotation and co-rotatable with said rotatable body, said tubes defining said refrigerant fluid passages.

16. The apparatus of claim 14 wherein said body comprises a pair of axially spaced plates secured to said hollow shaft, and said cylinder and piston elements are mounted between said plates.

17. Air cooling apparatus comprising, in combination: a hollow shaft mounted for rotation; power means for rotating said shaft; a first body secured to said shaft for co-rotation; a pair of first cylinders mounted on said first body in diametrically opposed relation and respectively defining first cylindrical fluid pressure chambers having axes radially spaced from the rotational axis of said first body; a pair of first pistons respectively cooperable with said cylinders and movable by centrifugal force to reduce the volume of the respective fluid pressure chambers to a minimum; a first annular crank support journalled on said hollow shaft; a pair of first crank arms secured to said annular crank support; connecting rod means respectively connecting said first crank arms to said first pistons, whereby said first annular crank support is oscillated by the reciprocal movement of said first pistons; a first fluid valve operable by said first annular crank support to an open position only when said pistons approach said minimum volume position; a second fluid valve operable by said first annular crank support to an open position only when said pistons are moving from their maximum volume positions toward said minimum volume position and said first valve is in a closed position; a room air heat exchanger having refrigerant fluid passages therethrough; a compressor co-rotatable with said hollow shaft; and conduit means for circulating a refrigerant fluid from each said first fluid pressure chambers, through said second valve, through said refrigerant fluid passages, through the bore of said hollow shaft to the inlet of said compressor, from the outlet of said compressor to said first valve and through said first valve to said fluid pressure chambers; a second body mounted on said hollow shaft for co-rotation, a pair of second cylinders mounted on said second body in diametrically opposed relation and respectively defining second cylindrical fluid pressure chambers having axes radially spaced from the rotational axis of said second body; a pair of second pistons respectively cooperable with said second cylinders and movable by centrifugal force to reduce the volume of the respective fluid pressure chambers to a minimum; a second annular crank support journalled on said hollow shaft; a pair of second crank secured to said second annular crank support; connecting rod means respectively connecting said second crank arms to said second pistons, whereby said second annular crank support is oscillated by the reciprocal movement of said second pistons; a third fluid valve operable by said second annular crank support to an open position when said second pistons approach said minimum volume position; a fourth fluid valve operable by said annular crank support to an open position only when said second pistons move from maximum volume positions to said minimum volume positions and said third fluid valve is in a closed position; and conduit means for conducting refrigerant fluid from each said second fluid chambers, through said fourth valve, through said refrigerant fluid passages, through the bore of said hollow shaft, to the inlet of said compressor, from the outlet of said compressor to said third valve and through said third valve to said second fluid chambers.

18. The apparatus of claim 17 wherein said heat exchanger comprises an assemblage of tubes parallel to the axis of rotation and co-rotatable with said rotatable body, said tubes defining said refrigerant fluid passages.

19. The apparatus of claim 16 wherein each said body comprises a pair of axially spaced plates secured to said hollow shaft, and the respective cylinder and piston elements are mounted between said plates.

20. Air cooling apparatus comprising, in combination: a shaft mounted for rotation; power means for rotating said shaft; a first and second set of a plurality of cooperating piston and cylinder elements mounted on said shaft in an equi-spaced array about the axis of rotation with said first set axially spaced from said second set; each cylinder element defining a fluid pressure chamber in which the respective piston element is shiftable by centrifugal force in a direction to reduce the volume of said fluid pressure chamber; a first valve means communicating with each said fluid pressure chamber of said first set and openable only when the respective piston elements approach the minimum volume position relative to said fluid pressure chambers; means for exhausting each said fluid pressure chamber of said first and second sets only when the respective pistons are remote from said minimum volume position relative to said fluid pressure chamber; a second valve means communicating with each fluid pressure chamber of said second set; means responsive to the movement of said first set pistons for controlling the opening of said second valve means, whereby said first and second valve means are operated sequentially; and means for supplying pressured fluid to said first and second valve means, whereby said pistons of said first set are energized in phase displaced relationship to the energization of said second set of pistons.

21. Air cooling apparatus comprising, in combination: a hollow shaft mounted for rotation; power means for rotating said shaft; a first and second set of a plurality of cooperating piston and cylinder elements mounted on said shaft in an equi-spaced array about the axis of rotation with said first set axially spaced from said second set; each cylinder element defining a fluid pressure chamber in which the respective piston element is shiftable by centrifugal force in a direction to reduce the volume of said fluid pressure chamber; a first valve means communicating with each said fluid pressure chamber of said first set and openable only when the respective piston elements approach the minimum volume position relative to said fluid pressure chambers; means for exhausting said fluid pressure chamber of said first and second sets and openable only when the respective pistons are remote from said minimum volume position relative to said fluid pressure chamber; a second valve means communicating with each said fluid pressure chamber of said first set; means responsive to the movement of said first set pistons for controlling the opening of said second valve means, whereby said first and second valve means are operated sequentially; and means for supplying pressured fluid to said first and second valve means, whereby said pistons of said first set are energized in phase displaced relationship to the energization of said second set of pistons; a room air heat exchaner mounted on said hollow shaft and having refrigerant fluid passages therethrough; a compressor co-rotatable with said hollow shaft; and conduit means for circulating a refrigerant fluid from each said fluid pressure chambers, through said second exhaust means, through said refrigerant fluid passages, through the bore of said hollow shaft to the inlet of said compressor, from the outlet of said compressor to said first and second valve means, and through said first and second valve means respectively to said first and second sets of fluid pressure chambers.

22. The apparatus of claim 21 wherein said heat exchanger comprises an assemblage of tubes parallel to the axis of rotation and co-rotatable with said rotatable shaft, said tubes defining said refrigerant fluid passages.

23. The apparatus of claim 20 or 21 wherein said first valve means comprises a check valve mounted in the axial end of said cylinder, resilient means urging said check valve to closed position, and an actuating stem on said check valve extending into said fluid pressure chamber and engageable by said piston element to open said check valve as said piston moves to said minimum volume position relative to said fluid pressure chamber.

24. Air cooling apparatus comprising, in combination: a rotatable body; power means for rotating said body; a cylinder element defining a fluid pressure chamber; a piston element cooperable with said fluid pressure chamber; means for mounting one of said elements on said rotatable body at a position radially spaced from the axis of rotation of said rotatable body, whereby centrifugal force produces relative movement of said piston element in said fluid pressure chamber in a direction to reduce the volume of said fluid pressure chamber; a first valve means communicating with said fluid pressure chamber and openable only when said piston element approaches the minimum volume position relative to said fluid pressure chamber; a second valve means communicating with said fluid pressure chamber openable only when said piston is remote from said minimum volume position relative to said fluid pressure chamber; one said valve means being closed whenever the other said valve means is open; a compressor co-rotatable with said hollow body; first conduit means co-rotatable with said body for directing air from said second valve means into a chamber to be cooled; and second conduit means for directing air from said chamber to the inlet of said compressor and from the outlet of said compressor to said first valve means.

25. The apparatus of claim 24 wherein said first valve means comprises a check valve mounted in the axial end of said cylinder, resilient means urging said check valve to closed position, and an actuating stem on said check valve extending into said fluid pressure chamber and engageable by said piston element to open said check valve as said piston moves to said minimum volume position relative to said fluid pressure chamber.

26. The apparatus of claim 24 wherein said rotating body is mounted on a hollow shaft, and the bore of said hollow shaft forms part of said second conduit means.

27. The apparatus of claim 24 wherein said chamber is a room and all of said apparatus except portions of said first and second conduit means is disposed exteriorly of the room.

28. The apparatus of claim 24 wherein said first conduit means terminates in diffusing nozzles rotating within said chamber.

29. Air cooling apparatus for a room having a ceiling comprising, in combination: a hollow shaft mounted for rotation about a vertical axis above a ceiling opening; a body secured to said shaft for co-rotation; power means for rotating said shaft; a plurality of cooperating piston and cylinder elements mounted on said body in an equi-spaced array about the axis of rotation; each cylinder element defining a fluid pressure chamber in which the respective piston element is shiftable by centrifugal force in a direction to reduce the volume of said fluid pressure chamber; a first valve means communicating with each said fluid pressure chamber and openable only when the respective piston element approaches the minimum volume position relative to said fluid pressure chamber; a second valve means communicating with each said fluid pressure chamber and openable only when the respective piston is remote from said minimum volume position relative to said fluid pressure chamber; a compressor co-rotatable with said hollow shaft; first conduit means co-rotatable with said body for directing air from each said fluid pressure chamber, through said second valve means, and thence into the room through the ceiling opening; and second conduit means including the bore of said hollow shaft for directing room air to the inlet of said compressor, from the outlet of said compressor to each said first valve means and through said first valve means to said fluid pressure chambers.

30. The apparatus of claim 29 wherein said first conduit means terminates in diffusing nozzles rotating within the room adjacent the ceiling.

31. The method of removing heat from a pressured gas comprising the steps of:

(1) rotating a cylinder and piston assembly about an axis spaced from and transverse to the path of relative movement of the piston and cylinder, whereby centrifugal force biases the piston to one extreme position relative to the cylinder;

(2) introducing a charge of pressured gas to the cylinder sufficient to relatively move the piston and cylinder to the other extreme position against the centrifugal force bias, thereby expanding and cooling the gas and increasing the rotating velocity of the piston and cylinder;

(3) removing the cooled and expanded gas from the cylinder and directing same through a heat exchanger to reheat same; and (4) compressing the reheated gas for re-introduction into the cylinder.

32. The method of claim 31 wherein the pressured gas comprises air.

33. The method of cooling a room by pressured air comprising the steps of:

(1) rotating a cylinder and piston assembly exteriorly of the room about an axis spaced from and transverse to the path of relative movement of the piston and cylinder, whereby centrifugal force biases the piston to one extreme position relative to the cylinder;

(2) introducing a charge of pressured air to the cylinder sufficient to relatively move the piston and cylinder to the other extreme position against the centrifugal force bias, thereby expanding and cooling the air and increasing the rotating velocity of the piston and cylinder;

(3) removing the cooled and expanded air from the cylinder and directing same into the room; and (4) withdrawing air from the room and compressing same for re-introduction into the cylinder.

34. The method of cooling a room by pressured air comprising the steps of:

(1) rotating a cylinder and piston assembly exteriorly of the room about an axis spaced from and transverse to the path of relative movement of the piston and cylinder, whereby centrifugal force biases the piston to one extreme position relative to the cylinder;

(2) introducing a charge of pressured air to the cylinder sufficient to relatively move the piston and cylinder to the other extreme position against the centrifugal force bias, thereby expanding and cooling the air and increasing the rotating velocity of the piston and cylinder;

(3) removing the cooled and expanded air from the cylinder and directing same into the room by a conduit co-rotatable with the cylinder and terminating in a diffusing nozzle rotating within the room; and (4) withdrawing air from the room and compressing same for reintroduction into the cylinder.

* * * * *

UNITED STATES PATENT AND TRADEMARK OFFICE

CERTIFICATE OF CORRECTION

PATENT NO. : 4,420,944

DATED : December 20, 1983

INVENTOR(S) : Edwin W. Dibrell

It is certified that error appears in the above-identified patent and that said Letters Patent is hereby corrected as shown below:

Column 7, line 30 after "26a" insert --by--.

Column 7, line 34 after "rotating", "plate" should be --body--.

Column 7, line 61 "directly" should be --directed--.

Column 8, line 20 after "body" insert --10--.

Column 11, line 14 "areas" should be --area--.

Column 11, line 56 "hollow" should be --rotatable--.

Column 12, line 13 "hollow" should be --rotatable--.

Column 14, line 48 after "crank" insert --arms--.

Column 14, line 54 after "position" insert --only--.

Column 15, line 25 after "each" insert --said--.

Column 15, line 61 "exchaner" should be --exchanger--.

Signed and Sealed this

*Seventh* Day of *August 1984*

[SEAL]

*Attest:*

GERALD J. MOSSINGHOFF

*Attesting Officer*

*Commissioner of Patents and Trademarks*